US006662376B2

(12) United States Patent
Cook

(10) Patent No.: US 6,662,376 B2
(45) Date of Patent: Dec. 16, 2003

(54) SEGMENTED FACE MASK AND SCREEN

(75) Inventor: Daniel G. Cook, Maple Plain, MN (US)

(73) Assignee: Health & Technology, Inc., Plymouth, MN (US)

( * ) Notice: Subject to any disclaimer, the term of this patent is extended or adjusted under 35 U.S.C. 154(b) by 17 days.

(21) Appl. No.: 10/042,649

(22) Filed: Jan. 9, 2002

(65) Prior Publication Data

US 2002/0088043 A1 Jul. 11, 2002

Related U.S. Application Data

(60) Provisional application No. 60/260,834, filed on Jan. 10, 2001.

(51) Int. Cl.[7] ..... A42B 1/18
(52) U.S. Cl. ..... 2/206; 2/207; 2/900
(58) Field of Search ..... 2/9, 206, 173, 2/207, 900, 11; 446/27; 128/857

(56) References Cited

U.S. PATENT DOCUMENTS

| | | | | | |
|---|---|---|---|---|---|
| 1,703,034 | A | * | 2/1929 | Grimes | 2/206 |
| 3,878,563 | A | | 4/1975 | Pulju | 2/9 |
| 4,050,457 | A | * | 9/1977 | Davidson | 128/202.28 |
| 4,635,625 | A | * | 1/1987 | Teeple | 128/858 |
| 4,662,156 | A | | 5/1987 | Oettel | 54/80 |
| 4,674,133 | A | | 6/1987 | Oschner | 2/206 |
| 4,856,535 | A | * | 8/1989 | Forbes | 128/857 |
| 4,901,714 | A | * | 2/1990 | Jensen | 602/41 |
| 4,979,236 | A | | 12/1990 | Merrill et al. | 2/4 |
| 5,035,004 | A | * | 7/1991 | Koester | 2/206 |
| 5,265,280 | A | | 11/1993 | Walsh | 2/206 |
| 5,546,604 | A | * | 8/1996 | Geller | 2/202 |
| 5,592,687 | A | * | 1/1997 | Lajeunesse | 2/9 |
| 5,669,395 | A | * | 9/1997 | Thompson | 128/846 |
| 5,701,892 | A | | 12/1997 | Bledstein | 128/206.19 |
| 5,765,231 | A | | 6/1998 | Leonard et al. | 2/206 |
| 6,012,171 | A | * | 1/2000 | Altman | 2/174 |
| 6,128,891 | A | | 10/2000 | McMahon | 54/80.1 |

* cited by examiner

*Primary Examiner*—Rodney M. Lindsey
(74) *Attorney, Agent, or Firm*—Kinney & Lange, P.A.

(57) ABSTRACT

The present invention is a face mask suitable for application to a person's skin. The mask comprises a mask segment of flexible sheet material and a screen element. The mask segment is conformable to at least a portion of the surface of the person's skin. The mask segment has a first surface, a second surface, and a shaped peripheral margin. The screen element also has a first surface. A decoration embellishes the first surface of the mask segment and the first surface of the screen element. A first fastener on the second surface of the mask segment attaches the segment to the person's skin. A second fastener attaches the screen element to the mask segment.

26 Claims, 2 Drawing Sheets

SEGMENTED FACE MASK AND SCREEN

CROSS REFERENCE TO RELATED APPLICATION

This application claims priority from provisional U.S. Patent Application Serial No. 60/260,834, filed on Jan. 10, 2001, for "Segmented Face Mask and Screen" by Daniel G. Cook.

BACKGROUND OF THE INVENTION

Decorating one's face by applying paint, make-up or a mask is well known to the young and old alike. For example, on Halloween, a significant number of children dress in costumes to go about their neighborhoods from door-to-door trick-or-treating. Adults participate in masquerade balls with lesser or greater involvement, but almost always involving some sort of disguise, usually in the form of a mask. Soldiers, hunters, or paint gun enthusiasts also decorate or camouflage themselves to disguise or hide their presence.

The styles of disguise and methods of achieving disguise vary widely. Some methods use paints or cosmetics in the form of colorful pigments suspended in a suitable base. These pigments are spread on a person's face to create the disguise or the chosen effect. This method requires eventual removal of the pigments, which can be time consuming and messy.

Traditional masks are useful if a person wishes to decorate or disguise his or her face while avoiding the disadvantages of applying pigments. However, masks may be cumbersome and difficult to manage, especially for young children. Moreover, masks frequently interfere with a wearer's vision, usually because of the distance the mask must be offset from the wearer's face, creating a tunnel vision effect. Another difficulty encountered, particularly with a full face mask, is interference with breathing, either from air obstruction or, more subtly, from poor air exchange caused by inadvertently trapping air behind the mask and forcing the wearer to rebreathe his or her exhaled breath. Depending on the size of the mask, the mask might interfere with motion of the head or become uncomfortable to wear because of a build up of heat that may cause sweating or other unwanted conditions.

More recently, decals have been developed whereby a decoration is applied to the surface of a small piece of thin, adhesive, plastic film. These decals are small because of the difficulty encountered in handling the plastic film. The film has a tendency to fold over on itself and render the decal useless. Consequently, only a very small surface area of skin is covered by a decal. The decals have also proven to be difficult to remove because of the thinness of the film. Often, the decals do not come off directly; rather, they are removed through the natural turnover of the skin as the skin surface sloughs off over time. These decals may become quite unsightly over time while they slowly disintegrate.

One solution to this problem is the use of a segmental face mask, taught by Leonard et al. in U.S. Pat. No. 5,765,231. However, a drawback of this mask is that relatively large areas of the face are still left exposed, most notably the area around the eyes. In some instances, it is important for a wearer to cover or camouflage the entire face, including the eyes. For example, wild turkey hunters must fully camouflage themselves due to turkeys' keen eyesight.

Thus, there is a need for a facial decorating or disguising mask that is easy to apply, will cover as much or as little of the face as is desired, is easily and cleanly removed, is non-irritating, and does not significantly interfere with the wearer's vision, breathing, or motion of the head or face.

BRIEF SUMMARY OF THE INVENTION

The present invention is a face mask suitable for application to a person's skin. The mask comprises a mask segment of flexible sheet material and a screen element. The mask segment is conformable to at least a portion of the surface of the person's skin. The mask segment has a first surface, a second surface, and a shaped peripheral margin. The screen element also has a first surface. A decoration embellishes the first surface of the mask segment and the first surface of the screen element. A first fastener on the second surface of the mask segment attaches the segment to the person's skin. A second fastener attaches the screen element to the mask segment.

DETAILED DESCRIPTION

Figure 1:
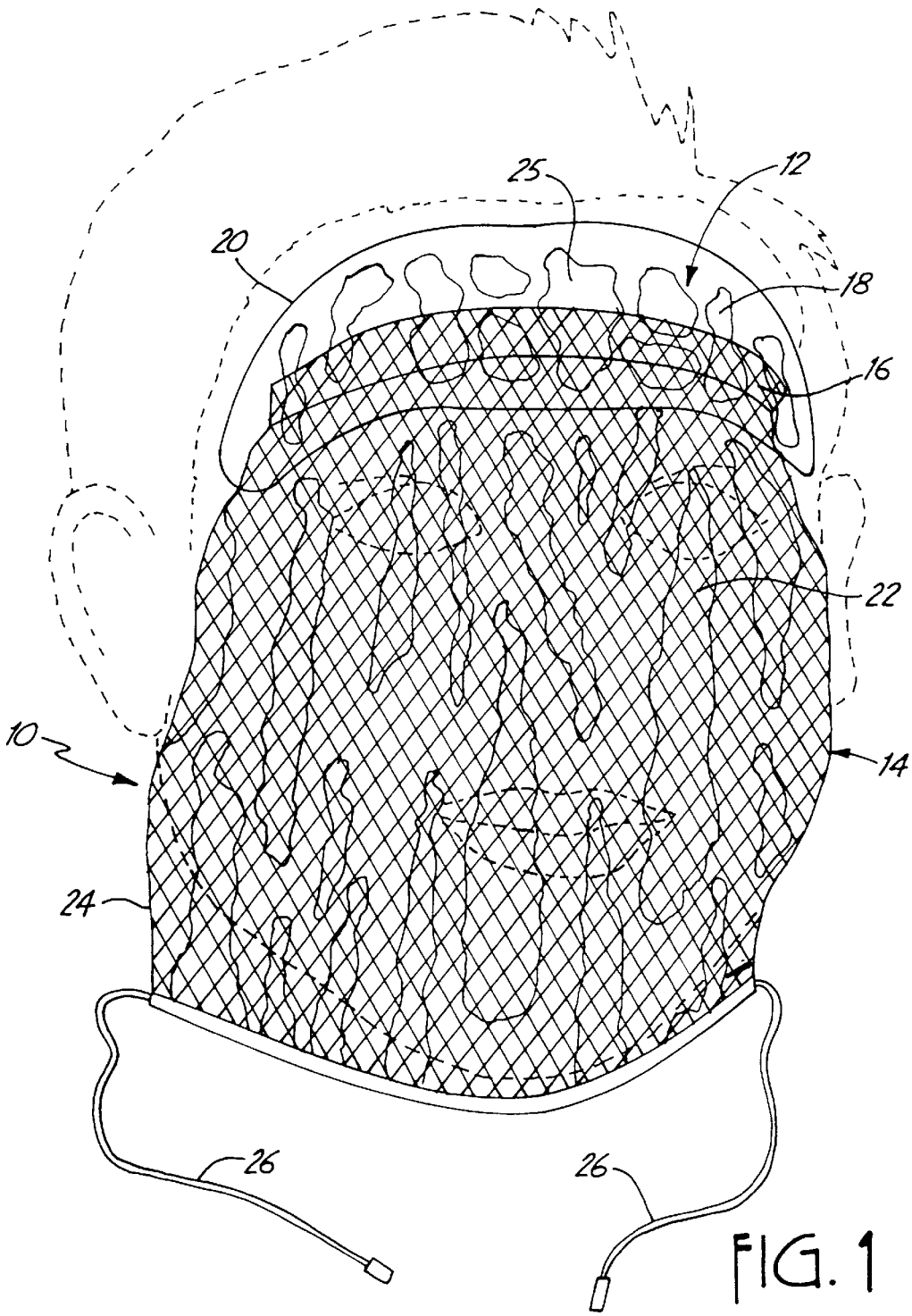
FIG. 1 is a perspective view of an embodiment of the present invention showing the relationship of the present invention to a person drawn in phantom.

FIG. 1 is a perspective view of an embodiment of segmented facial mask 10 of the present invention, showing the relationship of mask 10 to a person drawn in phantom. Segmented facial mask 10 comprises pan-forehead segment 12 and screen element 14. Screen 14 is attached to segment 12 at attachment area 16. Segment 12 comprises surface 18 and shaped peripheral margin 20. Screen 14 similarly comprises surface 22 and shaped peripheral margin 24.

Segment surface 18 and screen surface 22 display decoration 25 thereon. In FIG. 1, decoration 25 depicts a camouflage pattern. It is contemplated that decoration 25 may embody any color, pattern, picture, or other design. Decoration 25 may be affixed to surfaces 18 and 22 by any means known in the art, such as by printing, painting, inking, dyeing, silk-screening, or adhering a design-bearing decal thereon.

Segment 12 is conformable to at least a portion of the surface of the person's skin. Screen 14 is preferably made of a material that is flexible so that it does not cause discomfort. Preferably, screen 14 is a mesh screen made of a suitable size mesh which is sufficiently closed so that decoration 25 on surface 22 can be easily discerned, and also sufficiently open so as to not significantly interfere with the vision or breathing of the user. Screen 14 may be made of any suitable screen or mesh material, such as textiles, nylon, fiberglass, plastic, or even metal.

Screen 14 is attached to segment 12 at attachment area 16 by any fastener known in the art, such as by adhesives, buttons, zippers, hook and loop fasteners, or other devices and methods. Preferably, the attachment means allows for reuse of screen 14.

Retainer 26 is optionally incorporated with screen 14 to keep screen 14 in place. Retainer 26 is shown as a draw string. It is contemplated that retainer 26 may instead comprise a piece of elastic, a snap or button, or any other device or technique known in the art.

Figure 2:
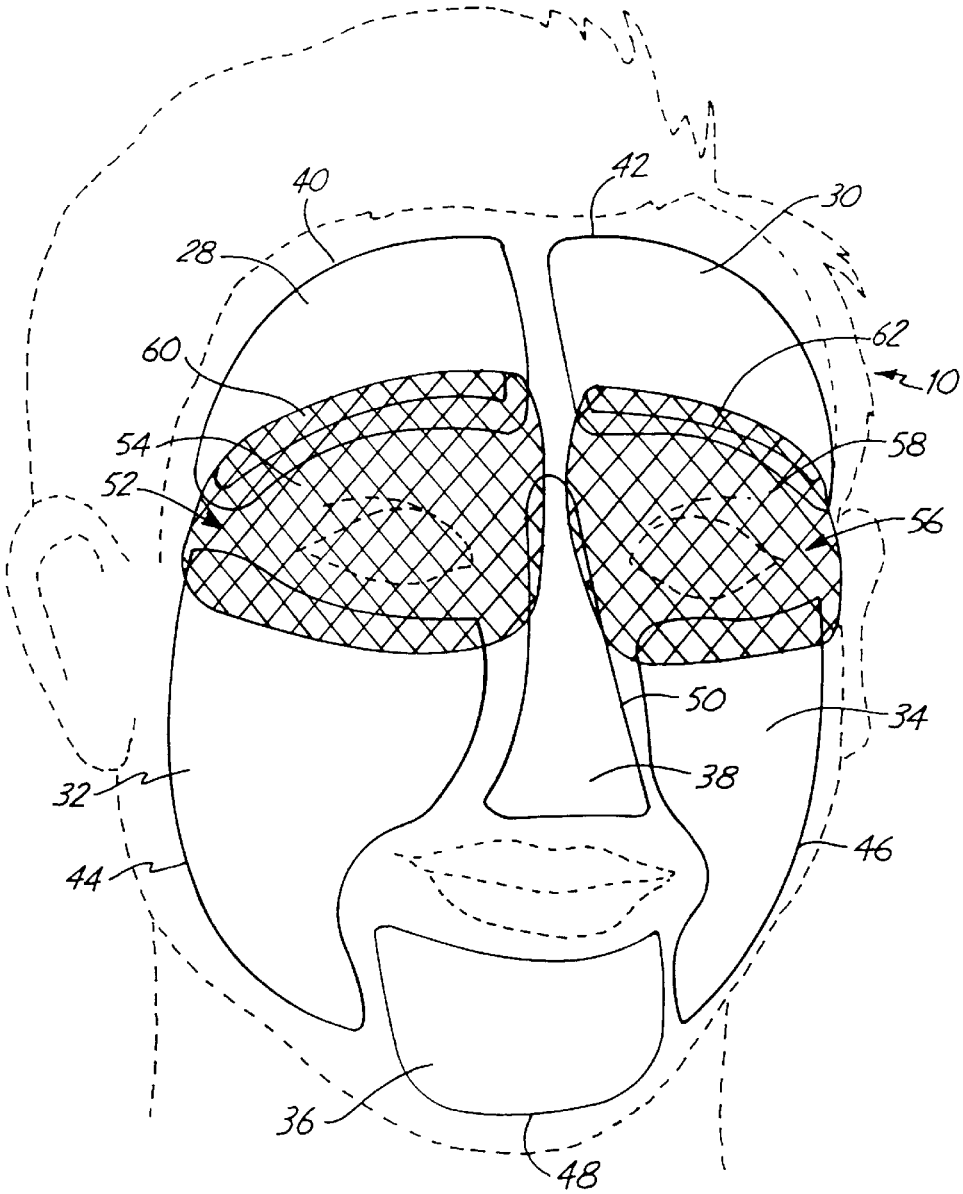
FIG. 2 is a perspective view of an alternative embodiment of the present invention.

FIG. 2 illustrates a second embodiment of segmented facial mask 10 which comprises multiple mask segments and multiple screen elements. It is contemplated that mask 10 can comprise any number and combination of segments and screen elements. FIG. 2 shows right forehead segment 28, left forehead segment 30, right malar segment 32, left malar segment 34, chin segment 36, and a nasal segment 38. A surface decoration such as decoration 25 of FIG. 1 is not shown for clarity of the illustration. However, it is to be understood that a decoration may similarly embellish the surfaces of mask 10 of FIG. 2.

In the embodiment shown in FIG. 2 the number of mask segments 28–38 is six. This number and arrangement of segments has been found to provide comfort and good coverage of the face in conjunction with adaptability to many different facial sizes and contours. Other numbers and arrangements of segments are contemplated, with a range from one to ten segments being preferable. As an example, different segments may be formed that will cover different regions or areas of the face. Right and left forehead segments 28 and 30 may be formed as a single pan-forehead segment 12 as illustrated in FIG. 1. Right and left malar segments 32 and 34 may be combined with nasal segment 38 as a single piece. Moreover, if the user does not have a mustache, additional segments (not shown) may be used to cover the skin above the lip and below the nose. Similarly, if the user has a goatee or beard, the use of chin segment 36 may be eliminated.

Many different combinations and numbers of segments may be used to provide for a versatile application of the present invention to accommodate many different decorations and designs to many different faces. The ability to change the numbers and arrangements of segments is an advantage of the present invention because the segments are able to act independently of each other. Even though a segment may mask a portion of a person's face, the person may enhance the visual experience of the mask by moving various facial muscles which move the various segments. Thus, a segment may be caused to move independently from another, adding more expression to the effect of the facial mask.

Another advantage of the present invention is the ability to contour mask segments 12 and 28–38. Each mask segment 12 and 28–38 is manufactured with a specific shaped peripheral margin 20 and 40–50, respectively, corresponding to the intended position on the person's face, and this shape is modifiable depending on the number of segments to be manufactured. The present invention also anticipates the usefulness of further modification of each mask segment at the time of application of the mask to the person's face. For example, each segment 12 and 28–38 may be customized to fit a particular user by trimming with a pair of household scissors.

Each mask segment 12 and 28–38 is arranged about the face so as to substantially cover the person's face. Each mask segment 12 and 28–38 is flexible and resilient so as to conform to the surface contours of the person's face without significantly interfering with vision, breathing or motion of the face or head.

Because it is difficult to comfortably cover the eye area with mask segments, right eye screen element 52 with surface 54 and left eye screen element 56 with surface 58 may be attached to right forehead segment 28 and left forehead segment 30 at right attachment area 60 and left attachment area 62, respectively. Imposing a decoration on screen surfaces 54 and 56 helps to hide otherwise exposed portions of the user's face. For example, use of a camouflage pattern on segments 28–38 as well as eye screen surfaces 54 and 58 may be especially helpful for hunters. In the case of a costume mask, eye screen surfaces 54 and 58 may be imprinted with fanciful eyes which complement the decoration of segments 28–38, resulting in a complete image perceived by viewers.

Because of the small size of each eye screen 52 and 56, the eye screens 52 and 56 are adequately held in place by their attachment at attachment areas 60 and 62 and the effect of gravity, without the need for a separate retainer. Alternatively, a second attachment area along the portions of eye screens 52 and 56 that overlap the right and left malar segments 32 and 34, respectively, is incorporated. This would be advantageous, for example, to prevent movement as a result of wind. Additionally, further screens may also be incorporated and attached to other mask segments to cover alternative portions of the user's face. For example, if a user has a beard or mustache which prevents adhesion of a mask segment, a screen element may instead be used to cover the user's mouth and chin area. Together, segments 28–38 and eye screens 52 and 56 cover substantially all of a person's exposed facial skin.

Figure 3:
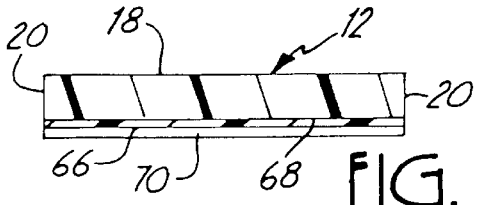
FIG. 3 is a cross-sectional view of a single mask segment.

FIG. 3 is a cross-sectional view of a single mask segment 12, which is also representative of mask segments 28–38. Segment 12 has first surface 18 suitable for bearing a decoration, second surface 66 for attachment of segment 12 to a user's skin, and shaped peripheral margin 20. The means of attachment may be any known fastener, such as the use of adhesive 68.

Segment 12 is preferably made from a flexible and resilient sheet material, such as paper, fabric, or polymeric sheeting materials which exhibit minimal to no skin reaction. A preferred material is polymeric foam, such as a poly-vinyl-chloride foam sold under the name Microfoam by 3M, St. Paul, Minn. Microfoam is hypo-allergenic and is often used in medical applications. Examples of other polymeric foams suitable for use in the present invention are those derived from polymers such as polyurethane, polypropylene, polyester, polyethylene and polystyrene. Other suitable materials are readily apparent to those skilled in the art.

The polymeric foam may be either open cell or closed cell in its construction. Preferably the polymeric foam is of a closed cell construction throughout for enhanced durability. However, an open cell construction with a closed cell "skin" is also acceptable. Mask segment 12 has first surface 18 that is suitable to receive a decoration. Depending on the means of decoration, surface 18 may be expected to receive paints, inks, and other dyes suitable for use on devices to be worn on a human. Preferably, such paints, inks, and dyes are also hypo-allergenic and non-toxic. Different polymeric foams will exhibit differences in lubricity, hydrophilia, hydrophobia and ionic moieties, which will affect acceptance of the chosen decoration onto surface 18.

Alternatively, a polymeric foam may be selected so as to have a surface suitable for receiving a decal decoration comprised of a decorative design carried on a thin film that is then layered onto surface 18. Another aspect of surface 18 is that it need not always be flat, but may be textured or contoured so as to enhance a given design or decoration applied to surface 18.

One method of forming different segments 12 and 28–38 uses sheets of polymeric foam material. The sheets may be passed through a machine capable of cutting the sheeting into appropriate shapes. This system is much like a collection of "cookie" cutters, each cutting die shaped to produce a corresponding mask segment. If appropriately backed, the polymeric foam may be passed through the machine as a long web. Appropriate backing may be chosen that incorporates a thin layer of pressure sensitive adhesive 68 combined with a removable release liner 70. Preferably, segments 12 and 28–38 may be cut by the cutting dies, which are set up to only cut the polymeric foam and not release liner 70. Release liner 70 then doubles as a backing layer upon which to carry the various mask segments 12 and 28–38 and from which each segment 12 and 28–38 is then peeled just prior to attachment to a person's face. One such pressure sensitive adhesive 68 is an iso-octo-acrylate and acrylic acid adhesive, also available from 3M. Adhesive 68 is preferably chosen for its non-irritating, hypo-allergenic and non-toxic characteristics, and a number of such pressure sensitive adhesives 68 for use on a skin are well known in the art.

Other attachment means will be obvious to those skilled in the art of applying decorations to skin. Examples of other fasteners are spirit gum and related liquid adhesives that may be coated onto mask segments 12 and 28–38 prior to application of mask segments 12 and 28–38 on the user's skin. Preferably, segments 12 and 28–38 and screens 14, 52, and 56 are attached by adhesives or other means which allow for removal and reuse of segments 12 and 28–38 and screens 14, 52, and 56.

Although the present invention has been described with reference to preferred embodiments, workers skilled in the art will recognize that changes may be made in form and detail without departing from the spirit and scope of the invention.

What is claimed is:

1. A face mask suitable for application to a person's skin, the face mask comprising:

a mask segment of flexible sheet material, the mask segment conformable to at least a portion of the surface of the person's skin; the mask segment comprising a first surface, a second surface, and a shaped peripheral margin;

a decoration on the first surface of the mask segment;

a first fastener on the second surface of the mask segment, suitable for attaching the mask segment to the person's skin;

a screen element having a first surface;

a decoration on the first surface of the screen element; and a second fastener suitable for attachment of the screen element to the mask segment.

2. The face mask of claim 1 in which the mask segment is made of a polymeric foam material.

3. The face mask of claim 2 in which the polymeric foam is a closed cell foam.

4. The face mask of claim 2 in which the polymeric foam includes a polymer chosen from a group of polymers consisting of: polyurethane; polyethylene; polypropylene; polyester; poly-vinyl-chloride; and polystyrene.

5. The face mask of claim 1 in which the first fastener includes a pressure sensitive adhesive.

6. The face mask of claim 5 further comprising:

a removable release liner adjacent the pressure sensitive adhesive.

7. The face mask of claim 1 in which the first fastener includes a liquid adhesive.

8. The face mask of claim 1 in which the decoration on the first surface of the mask segment includes at least one painted design.

9. The face mask of claim 1 in which the decoration on the first surface of the mask segment includes at least one inked design.

10. The face mask of claim 1 in which the decoration on the first surface of the mask segment includes a design-bearing decal sufficient to cover at least a portion of the first surface of the mask segment.

11. The face mask of claim 1 in which the second fastener includes an adhesive.

12. The face mask of claim 1 in which the decoration on the first surface of the screen element includes at least one painted design.

13. The face mask of claim 1 in which the decoration on the first surface of the screen element includes at least one inked design.

14. The face mask of claim 1 wherein the mask segment and the screen element cover substantially all of the person's facial skin.

15. The face mask of claim 1, and further comprising:

a retainer incorporated with the screen element to keep the screen element in a desired position.

16. The face mask of claim 1 wherein the screen element covers at least the skin surrounding an eye of the person.

17. The face mask of claim 16 wherein the second fastener is adapted to be located above the person's eye.

18. The face mask of claim 16 in which the mask segment is made of a polymeric foam material.

19. The face mask of claim 16 in which the first fastener includes a pressure sensitive adhesive.

20. The face mask of claim 1 wherein the screen element covers at least the skin surrounding a mouth of the person.

21. The face mask of claim 1 in which the screen element is reusable.

22. A face mask suitable for application to a person's skin, the face mask comprising:

a mask segment of polymeric foam material, the mask segment conformable to at least a portion of the surface of the person's skin; the mask segment comprising a first surface, a second surface, and a shaped peripheral margin;

a decoration on the first surface of the mask segment;

an adhesive on the second surface of the mask segment, suitable for attaching the mask segment to the person's skin;

a screen element having a first surface;

a decoration on the first surface of the screen element; and a fastener suitable for attachment of the screen element to the mask segment.

23. A method of applying a face mask to a person's skin the method comprising:

adhering a mask segment of flexible sheet material to the person's skin; and positioning a screen element to cover the person's skin, the screen being unattached to the person's skin, wherein the screen element has a first portion and a second portion, the first portion of the screen element being attached to the mask segment and the second portion of the screen element being unattached to the mask segment.

24. The method of claim 23 in which the mask segment and the screen element cover substantially all of the person's face.

25. The method of claim 23 further comprising:

removing the mask segment from a release liner before adhering the mask segment to the person's skin.

26. The method of claim 23 further comprising:

coating a surface of the mask segment with an adhesive before adhering the mask segment to the person's skin.

* * * * *